United States Patent [19]

Wagner et al.

[11] Patent Number: 4,598,168

[45] Date of Patent: Jul. 1, 1986

[54] STRAIN SENSITIVE CABLE

[75] Inventors: Gilbert F. Wagner, Vienna, Va.; Arthur C. Tiemann, Albuquerque, N. Mex.

[73] Assignee: The United States of America as represented by the Secretary of the Army, Washington, D.C.

[21] Appl. No.: 555,916

[22] Filed: Nov. 29, 1983

[51] Int. Cl.[4] ..... G08B 13/12; H01B 7/00

[52] U.S. Cl. ..... 174/115; 174/111; 340/551; 340/561; 340/565

[58] Field of Search ..... 174/115, 111; 340/551, 340/561, 562, 565, 566, 567

[56] References Cited

U.S. PATENT DOCUMENTS

| | | | |
|---|---|---|---|
| 3,610,808 | 10/1971 | Horwinski | 174/124 G X |
| 3,747,036 | 7/1973 | Erdmann | 336/181 X |
| 4,001,745 | 1/1977 | Goodman | 336/180 X |
| 4,047,166 | 9/1977 | Miller et al. | 174/98 X |
| 4,131,758 | 12/1978 | Felkel | 174/107 |
| 4,166,264 | 8/1979 | Starr | 336/20 |

*Primary Examiner*—Arthur T. Grimley
*Assistant Examiner*—Morris H. Nimmo
*Attorney, Agent, or Firm*—John E. Becker; Anthony T. Lane; Robert P. Gibson

[57] ABSTRACT

A strain sensitive coaxial cable is disclosed as comprising a centrally disposed conductor about which is disposed a first insulating layer, and a second conductor disposed coaxially about the center conductor, configured as a helix and dimensioned to loosely fit with respect to the first dielectric layer and to permit relative axial movement generally between the second conductor and the first dielectric layer, whereby more uniform signals, and elastic-inelastic strain discrimination are provided and spurious outputs eliminated. An outer protective sheath is disposed about the helical turns of the second conductor. Another form includes using spaced mechanical means such as collar members at spaced intervals frictionally affixed to both the dielectric layer around the center conductor and the second helical conductor to prevent movement of those frictionally engaged spaced portions of the second conductor with respect to the dielectric layer around the center conductor, thereby reducing the possibility of providing false or spurious outputs due to strain relief of the cable.

5 Claims, 4 Drawing Figures

STRAIN SENSITIVE CABLE

BACKGROUND OF PRIOR ART

The present invention pertains to intrusion detection systems and in particular to coaxial strain sensitive cables responsive to energy applied thereto to provide an output signal indicative of the presence of an intruder when used in such systems.

Intrusion detection is becoming more important, both in military and civilian applications. Military bases and other installations, e.g. factories, power stations, stores and even private homes, are being protected by sophisticated electronic surveillance systems which are capable of monitoring the periphery of such a facility to provide a manifestation or warning indicative of the presence of an intruder. One type of such an intrusion detection system incorporates a sensing element in the form of a coaxial cable concealed in the ground and disposed about the outer edge or perimeter of the area to be protected. The sensing element is sensitive to the presence of the intruder of whatever type and is responsive to the movement of a person or object approaching the periphery, to produce a manifestation indicating such an intrusion.

In the prior art, intrusion detection sensors have been developed which recognize magnetic field surface disturbances to intercept and detect non-metallic objects moving across the periphery of the area to be guarded. An example of the patents disclosing such sensors in the form of a cable is U.S. Pat. No. 4,001,745 of Goodman. Such a magnetic field surface disturbance sensor typically includes a central core extending along an axis having a plurality of wires formed as coils disposed about the core with a jacket disposed to protect the entire aforementioned assembly. It is disclosed that the coils are wound with a predetermined tightness about the core dependent upon the expected seismic sensitivity to prevent extraneous activity, such as thunder or explosion, from producing a magnetostrictive signal. Similar sesnors are also disclosed in U.S. Pat. No. 4,166,264 of Starr and U.S. Pat. No. 3,747,036 of Erdmann.

Further, U.S. Pat. No. 4,206,451 of Kurschner discloses a system adapted to receive the output of a sensor as disclosed in U.S. Pat. No. 3,747,036 to filter and supply the output to a logic circuitry, which detects the amplitude of the input signal and its zero crossing history to determine whether the magnetically detected signal is that of an intruder. A further type of cable sensor is disclosed in U.S. Pat. No. 3,610,808 of Horwinski. This cable sensor includes a coaxially configured wire braid made of close woven wires, each such wire being insulated from the other and connected in a grid to form a continuous trigger circuit to be connected to a detection device providing an indication of any alteration of the trigger circuit characteristics. Thus, if excessive stress breaks one of the wires of low ductility of the trigger circuit, the detection device provides an indication of an abnormal condition.

In addition to those sensors which sense a change of the magnetic field or the establishment of an open or short circuit condition within a cable, there are strain sensitive coaxial cables comprising a center conductor, and a first dielectric layer and a second conductor in the form of a braided wire or a solid cylindrically shaped conductor both disposed coaxially about the center conductor. This strain sensitive cable is provided with a protective shield and is responsive to the application of stress as by an intruder to provide a signal upon the central conductor which may be detected to provide an alarm indicating the intruder's presence. Although the precise nature of the operation of such cables is not fully understood, it is theorized that the application of a pressure or force to such a coaxial cable results in relative movement between the second coaxial conductor to establish a charge upon the first dielectric layer. The charge is capacitively coupled to the center conductor to produce a signal therein that may be detected by a detection circuit to provide an alarm indicating the presence of an intruder. Problems have developed with such coaxial cables, whereby spurious output signals from the center conductor may be produced even in the absence of an intruder. It is believed that due to the structure of the solid or braided second conductor, that the second conductor does not move freely with respect to the first dielectric layer with the result that as the cable or associated structure relaxes with age, i.e. strain relief, relative movement occurs between the second conductor and the first dielectric layer to produce an undesirable spurious output signal.

U.S. Pat. No. 3,963,854 of Fowler and U.S. Pat. No. 4,131,758 of Felkel each relate to coaxial, shielded cables for transmitting data or power as opposed to sensing strain to provide an output signal indicative thereof. The significance of each of these patents is that it relates to cables having a center conductor about which there are disposed helically wound conductors. However, neither of these references disclose a cable that is adapted to sense the imposition of strain thereto and to permit relatively free movement between its helically wound conductors and its dielectric layer covering the center conductor.

BRIEF SUMMARY OF THE INVENTION

It is an object of this invention to provide new and improved strain sensitive coaxial cables in which the problems associated with the strain relief as the cable relaxes, are substantially overcome.

It is a more particular object of this invention to provide new and improved strain sensitive coaxial cables having a higher output level and improved signal to noise ratio, as well as an improved uniformity in the linearity of its output signal with respect to the application of a force to the cable.

It is a more particular object of this invention to provide a new and improved strain sensitive coaxial cable wherein the second or outer conductor is so configured and formed to move relatively freely in the axial direction but relatively stiff in the radial direction or plane of the center conductor and cable as a whole whereby an improved amplitude and uniformity of output from the cable is obtained.

In accordance with these and other objects of the invention, there is provided a strain sensitive coaxial cable comprising a centrally disposed conductor about which is disposed a first insulating layer, and a second conductor disposed coaxially about the center conductor, configured as a helix and dimensioned to loosely fit with respect to the first dielectric layer and to permit free relative axial movement between the second conductor and the first dielectric layer. An outer elastomeric sheath is disposed about the helical turns of the second conductor.

In one aspect of this invention, retaining means are disposed at regular intervals along the length of the coaxial cable to prevent movement of the second conductor with respect to the dielectric layer due to strain release as the coaxial cable ages. One form of the retaining means illustratively shown in FIG. 2 comprise a cylindrical member or collar disposed as spaced intervals between the first dielectric layer and the second helically shaped conductor to prevent movement of the spaced portions of the second conductor with respect to the first dielectric layer and therefore reduce the possibility of providing false outputs due to strain relief. Another form of retaining means is illustratively shown in FIG. 2A, wherein the cylindrical collar members are omitted, and spaced portions of the second or outer conductor are crimped in a retaining relationship against the dielectric layer of the center conductor.

In a still further aspect of this invention, detection means are provided to detect and distinguish the presence of an intruder as opposed to a false output as would be produced by the normal aging or strain relief action of a coaxial cable or the surrounding media. More specifically, the detection means senses an elastic strain induced signal as produced by an intruder momentarily exerting a force upon the strain sensitive coaxial cable of this invention, i.e. that bipolar signal as produced by a first axially directed movement between the helically shaped second conductor and the first dielectric layer and a second return movement to the initial position. The signal is applied to the detection means comprising amplifying means for converting the input current signal to a voltage signal and amplifying the voltage signal to a level that is capable of being detected, first threshold detection means in the form of a threshold detector for detecting a positive going signal in excess of a predetermined level, second threshold detection means for detecting negative going signals above a predetermined level, and means for providing an output when the input bipolar signal exceeds both a negative and positive threshold level as sensed by the first and second threshold detection means. In this manner, a more accurate indication can be given of whether an intruder is present or the output in due to an inelastic stimulus such as a strain relief of cable or surrounding media.

BRIEF DESCRIPTION OF THE DRAWINGS

For a more complete understanding of the present invention, reference is hereby made to the drawings in which.

DETAILED DESCRIPTION OF THE INVENTION

Figure 1:
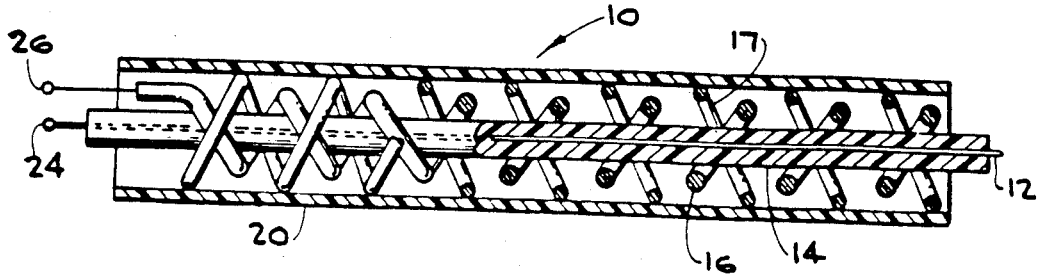
FIG. 1 is a cut-away view of a strain sensitive coaxial cable in accordance with the teachings of this invention.

Referring now to the drawings and in particular to FIG. 1, there is shown a strain sensitive coaxial cable 10 in accordance with the teachings of this invention and comprising a center conductor 12 about which is disposed concentrically a first layer 14 of a suitable solid dielectric material such as a polytetraflourethylene known under the trademark of DuPont as TEFLON. The center conductor 12 may illustratively be made of any electrically conductive material such as copper or steel. In accordance with the teachings of this invention, there is disposed a second helically configured conductor 16 that is disposed loosely about the dielectric layer 14 and coaxially of the center conductor 12. The second conductor 16 is loosely spaced with respect to the dielectric layer 14 within the di-electric space between it and an outer sheath to permit the lateral or axial non-binding movement of the helically configured conductor 16 with respect to the dielectric layer 14 thus increasing the sensitivity, the signal to noise ratio and the uniformity of the resultant output signal that appears upon the center conductor 12, as will be explained. In a further aspect of this invention, a third conductor 17 may be wound in a second direction opposite to that of the first helical conductor. The third helically configured conductor 17 spaces the first helically configured conductor 16 from an outer sheath 20, thus further ensuring freedom of axial movement of the second helically shaped conductor 16 with respect to the dielectric layer 14. The second and third helically configured conductors are made of an electrically conductive material having a high degree of elasticity such as stainless steel. The sheath 20 may be made of a suitable dielectric material such as polyurethane. The first helically shaped conductor 16 is formed with a pitch which is not critical but typically is in the range of $1\frac{1}{8}$D to $1\frac{1}{4}$D (D being the diameter of the conductor 16) to maintain its radial dimensions under normal stress while providing a high degree of flexibility in the axial direction. By maintaining the pitch, the axial spacing between successive turns of the helically configured conductor 16 is maintained in the range of $\frac{1}{8}$D to $\frac{1}{4}$D, where D is the diameter of the conductor 16. If the conductor 16 is configured with a lesser pitch, there results an insufficient axial movement between the conductor 16 and the dielectric layer 14. The outer diameter of the first dielectric layer 14 is made slightly less, typically 0.005 to 0.01 of an inch, then the inner diameter of the helically configured second conductor 16. Care is taken during the forming either by winding or helically slitting a solid tube to maintain smooth the inner surface of the conductor 16 to ensure its relative movement with respect to the dielectric layer 14.

It is contemplated that the strain sensitive coaxial cable 10 may be disposed along the perimeter of the area to be protected. Illustratively, a V-shaped trench is dug into the earth to a depth in the order of eight inches and thereafter an extended length of the cable 10 disposed therein. Though only a short segment of the cable is illustrated, it is contemplated that an extended length of the cable 10 may be used. The soil is placed about the cable 10 and is packed to eliminate any voids. When extended lengths of the strain sensitive coaxial cable 10 are used, a current type of amplifier presenting a relatively low impedance to the output of the cable 10 as appears at terminals 24 and 26, is used to amplify the small currents typically in the order of $10^{-7}$ amps and to provide a voltage output in the order of 1 volt. In addition, the contemplated current type amplifier prevents the added coupled capacity of an extended length of the cable 10 from adversely affecting the current output signal.

There is provided by the structure of the strain sensitive coaxial cable 10 as described with respect to FIG. 1, a more effective and reliable means of detecting an intruder. First, there is less static friction created between the conductor 16 and its dielectric layer 14 thus creating a higher sensitivity to the pressure imposed by an intruder and increasing the signal to noise ratio of the cable's output signal. Secondly, the sheath 20 may shrink longitudinally with age imposing a further pressure on the conductor 16; even so, the structure of the cable 10 permits the relatively free movement of the conductor 16 with respect to its dielectric layer 14 thus assuring the relatively high sensitivity and uniformity of output signal. Further, the effects of strain imposed on the second conductor 16 induce erratic movement between the conductor 16 and its dielectric layer 14 as occur when these elements are not free to move with respect to each other and the resultant strain on the second conductor 16 builds up to a large level causing an erratic movement to impose a spurious output. To prevent this erratic movement, the coaxial cable is configured and dimensioned to permit the relative movement between the first dielectric layer 14 and the second conductor 16. In addition, the cable 10 is highly resistant to crushing radially directed forces, while providing a high degree of flexibility in bending and tensile modes.

Figure 2:
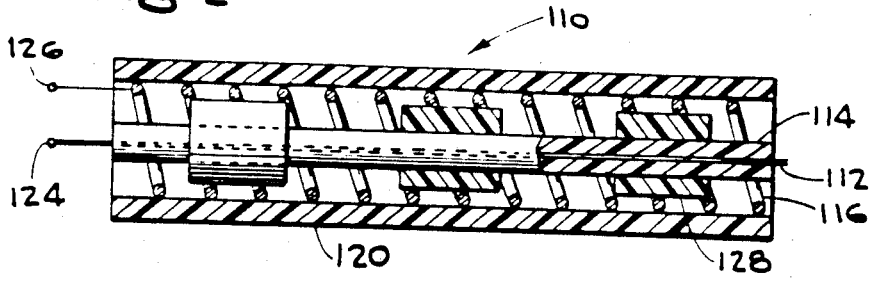
FIG. 2 shows a further illustrative embodiment of the coaxial cable of this invention including mechanical restrainers.
Figure 2A:
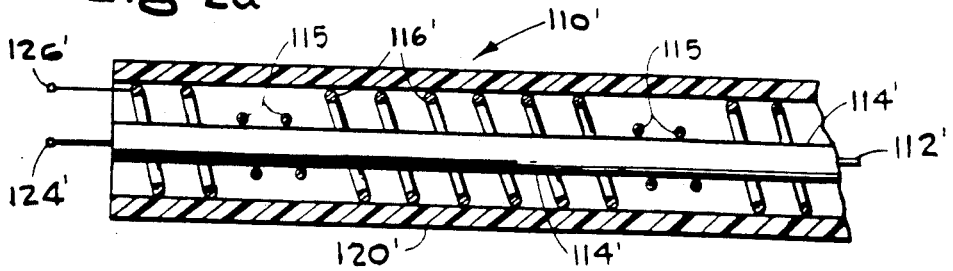
FIG. 2A shows still another illustrative embodiment of the coaxial cable of this invention showing a modified form of mechanical restrainers.

In FIG. 2, there is shown a further embodiment of this invention, where similar elements are identified by similar numbers except in the one hundred series. Additionally, there is shown mechanical retainers in the form of cylindrically shaped members 128 disposed between the dielectric layer 114 and the helically wound conductor 116. In particular, the members 128 are formed as by clamping about the first dielectric layer 114 and may be made of a suitable dielectric material such as polyvinyl. The second helically shaped conductor 116 is formed tightly about the members 128 to prevent the axial movement of the conductor 116 with respect to the dielectric layer 114 at the points where the members 128 are placed. Thus, the strain imposed on the cable 110 as it ages, is suppressed, and erratic movement of the conductor 116 with respect to its dielectric layer 114 is inhibited from producing a false output indicative of the presence of an intruder. An alternative modification of this embodiment is illustrated in FIG. 2A, wherein primed reference numbers are used for the parts designated by unprimed counterpart reference numbers in FIG. 2. In this FIG. 2A embodiment, the aforesaid members 128 may be deleted and the spaced portions 115 of the conductor 126' crimped in a retaining relationship against the dielectric layer 114'.

Figure 3:
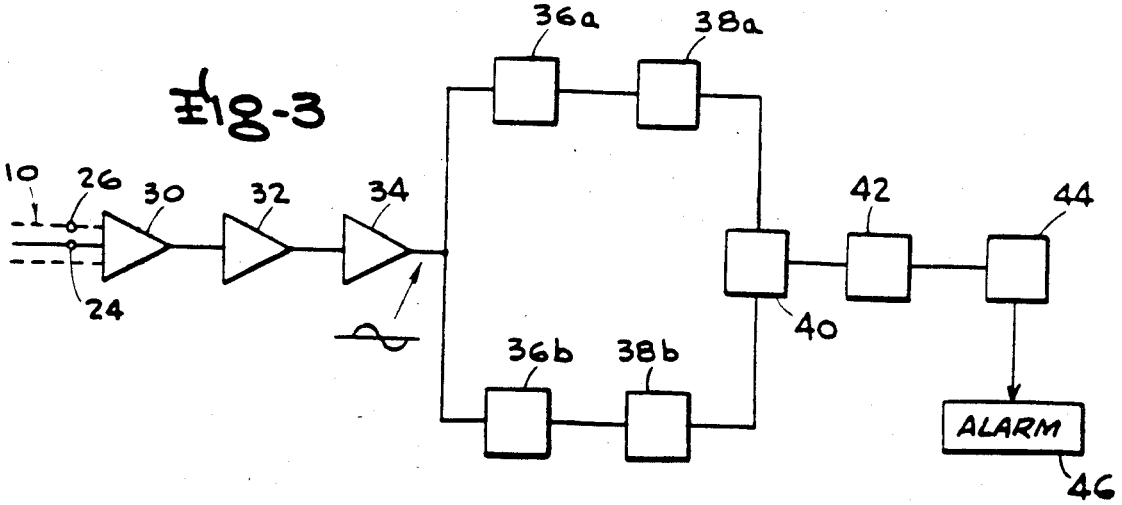
FIG. 3 shows a functional block diagram of a detection circuit coupled to the output of the strain sensitive coaxial cable of FIGS. 1, 2 or 2A to provide an output manifestation indicative of the presence of an intruder and in particular of the reception of a bipolar signal.

In FIG. 3, there is shown a functional block diagram of means in the form of a circuit for detecting the presence of bipolar signals appearing upon the output terminals 26 and 24 of the cable 10 as shown in FIG. 1. As briefly indicated above, in the presence of an intruder, a force is exerted upon the ground surrounding the cable 10 whereby the second helically configured conductor 16 tends to move in a first direction and upon release of the force, the conductor 16 tends to move in a second, opposite direction to its initial position. Thus, due to what is believed to be a tribo-electric effect, a first electrostatic charge is induced in the dielectric layer 14 of a first polarity and upon the return of the conductors 16 to its first position, a charge of an opposite polarity is induced therein. The charges of opposite polarity in turn induce a bipolar signal in the conductor 12 which is coupled as shown in FIG. 3 to a charge amplifier 30. The frequency of such a signal as effected by human intrusion is in the order of 0.2 to 2.5 Hz. Though not described in detail herein, it is contemplated that the frequency of the signal may be detected to provide an indication of the nature of the intruder. The output of the charge amplifier 30, typically in the order of 1 volt, is serially applied to amplifiers 32 and 34 each imparting a gain illustratively in the order of 40 db. As shown in FIG. 3, the output of amplifier 34 is a bipolar voltage signal and is applied to each of a first positive threshold detector **36*a* and a second negative threshold detector 36*b*. Upon detection of a positive going signal above a pedetermined variable level, the threshold detector 36*a* provides an output to a first one-shot multi-vibrator 38*a* which provides an output of a predetermined interval, e.g. 3 seconds. Similarly, if a negative going signal of a predetermined variable amplitude is detected by the threshold detector 36*b*, an output is applied to trigger a second one-shot multi-vibrator 38*b*, which provides an output of a duration similar to that of the first one-shot multi-vibrator 38*a***.

As shown in FIG. 3, both outputs of the multi-vibrators **38*a* and 38*b* are applied to an AND gate 40 which detects the coincidence of the multi-vibrator outputs to provide its output indicating the detection of a bipolar signal as derived from the strain sensitive coaxial cable 10. The AND gate output is in turn applied to a one-shot multi-vibrator 42 which provides its output of a predetermined duration, e.g. 0.5 seconds, to an emitter follower 44 which performs a buffer function between the aforementioned circuit and a suitable alarm utilization device 46. Typically, the alarm utilization device 46 may take the form of an audible or light emitting device that is activated upon the detection as described above of the bipolar signal to alert suitable personnel to the presence of an intruder. Alternatively, the output of the emitter follower 44** could be applied to a distant station as by telephone lines to provide the warning manifestation.

It is contemplated that the subject system may be used in other applications other than for detection of physical stimuli produced by cultural or natural sources. For example, in earth structures such as water dams (dykes), built up roads, banks, fault areas, etc., it is often desirable to monitor the amplitude and shifts in critical portions to determine structure degradation to predict incipient failures. The unique capability of this system to detect and discriminate elastic and inelastic strains permits collecting data from which this vital information can be extracted. For example, in the case of an earthen dam, high incidence of inelastic earths shifts of significant amplitude would indicate an incipient catastrophic failure. Likewise the subject system is applicable of monitoring fixed and mobile structural elements including aircraft, bridges, pipelines, towers, cranes, roads, stairways, walls or other structural elements possibly subject to failure due to excessive loading or intrusions. This system is capable of detecting the amplitude and frequency of elastic strains which permits prediction of fatigue weakening, and of detecting the amplitude and frequency of inelastic strains, which permits prediction of structure degradation which could lead to catastrophic failure. Further, this system is also capable of monitoring normal structural functions including pressure changes in hydraulic systems, vibrational functions of machinery, seismic/sonar activity, speed/weight of vehicles, frequency and amplitude of events of moving masses, and acceleration.

Thus, there has been described a strain sensitive cable for sensing the presence of a physical stimuli comprising a center conductor, a first insulator disposed concentrically thereabout and a helically configured conductor spaced therefrom to provide relatively free movement between the dielectric layer and the helically configured conductor whereby inadvertent movement due to strain relief and aging will not produce erratic signal outputs from the cable. Physical stimuli due to human intrusion produce bipolar signals which are sensed by first and second detector means responsive to the negative and positive going swings of such bipolar signals. AND gate means is used to detect the coincidence of the outputs of such detector means to provide a manifestation indicative of the bipolar signal and thus human intrusion.

While specific embodiments have been illustrated and described herein, it is theorized that modifications and changes will occur to those of skill in the art. It is therefore to be understood that the appended claims are intended to cover all such modifications and changes which fall within the true spirit and scope of the invention.

We claim:

1. A strain sensing cable adapted to be coupled to a structure for detecting a physical stimulus imparting a strain thereto, said strain sensing cable comprising:

a. a first central conductor disposed along an axis of said strain sensing cable;

b. a layer of solid dielectric material surrounding said central conductor;

c. a second conductor configured as a helix and disposed loosely around said dielectric layer, said helix having an inner diameter selected to permit the free lateral or radial movement through a gas dielectric such as air of said second conductor with respect to said solid dielectric layer without compressing the solid dielectric material, whereby charges are built up within said dielectric layer upon the imposition of strain to said sensing cable and the resultant relative movement of said second conductor with respect to said dielectric layer; and d. wherein the pitch and said helix configuration of said second conductor are selected to permit the free relative movement of said second conductor with respect to said solid dielectric layer and to resist deformation due to radially exerted forces towards said axis of said strain sensing cable, said pitch and the helical configuration being approximately within a range of about $1\frac{1}{8}$D to $1\frac{1}{4}$D, where D is the diameter of the second conductor, and with the axial spacing between successive turns of the helical second conductor being in an exemplary range of about $\frac{1}{8}$D to $\frac{1}{4}$D; and e. a protective sheath disposed about said second conductor.

2. The strain sensing cable as claimed in claim 1, wherein said second conductor is configured as a helix wound in a first direction, and there is included a third conductor configured as a helix wound in a second direction opposite to said first direction and disposed concentrically around said second conductor in slightly spaced relation to assure free axial and radial movement relative to said first and second conductors.

3. A strain sensing cable adapted to be coupled to a structure for detecting a physical stimulus imparting a strain thereto, said strain sensing cable comprising:

a. a first central conductor disposed along an axis of said strain sensing cable;

b. a layer of dielectric material surrounding said central conductor;

c. a second conductor configured as a helix and disposed loosely around said dielectric layer, said helix having an inner diameter selected to permit the free lateral or radial movement through a gas dielectric such as air of said second conductor with respect to said solid dielectric layer without compressing the solid dielectric material, whereby charges are built up within said dielectric layer upon the imposition of strain to said sensing cable and the resultant relative movement of said second conductor with respect to said dielectric layer; and d. wherein there is included a plurality of retainer members disposed at regular intervals along the length of said strain sensing cable and between said solid dielectric layer and said second conductor for engaging a plurality of corresponding portions of said second conductor and said solid dielectric layer in a maner to restrain the movement of said plurality of portions with respect to said solid dielectric layer; and e. a protective sheath disposed about said second conductor.

4. The strain sensing cable as claimed in claim 3, wherein each of said plurality of retainer members is of a cylindrical configuration and made of a dielectric material.

5. A strain sensing cable adapted to be coupled to a structure for detecting a physical stimulus imparting a strain thereto, said strain sensing cable comprising:

a. a first central conductor disposed along an axis of said strain sensing cable;

b. a layer of dielectric material disposed around and surrounding said central conductor;

c. a second conductor configured as a helix and disposed loosely around said dielectric layer, said helix having an inner diameter selected to permit the free lateral movement of said second conductor with respect to said dielectric layer, whereby charges are built up within said dielectric layer upon the imposition of strain to said sensing cable and the resultant relative movement of said second conductor with respect to said dielectric layer;

d. a plurality of retainer members disposed at regular spaced intervals along the length of said cable, said retainer members being operatively connected to a plurality of generally corresponding portions of both said second conductor and said solid dielectric layer in a manner to restrain the movement of said second conductor's plurality of corresponding portions with respect to said solid dielectric layer, each of said plurality of retainer members includes short integral crimped portions of said second conductor helix, which crimped portions essentially frictionally engage without compressing said solid dielectric layer, and a spring character of the second conductor helix holds it freely away from said solid dielectric layer; and e. a protective sheath disposed around said second conductor.

* * * * *